US008459505B2

(12) United States Patent
Martindale et al.

(10) Patent No.: US 8,459,505 B2
(45) Date of Patent: Jun. 11, 2013

(54) LOCKING ACCESS PLUG FOR A BAR GUN

(75) Inventors: Richard A. Martindale, Vacaville, CA (US); Bret D. Baker, Vacaville, CA (US); Albert A. Soldano, Shingle Springs, CA (US); Robert A. Lorenz, Sacramento, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 336 days.

(21) Appl. No.: 12/871,728

(22) Filed: Aug. 30, 2010

(65) Prior Publication Data

US 2011/0073617 A1 Mar. 31, 2011

Related U.S. Application Data

(60) Provisional application No. 61/238,047, filed on Aug. 28, 2009.

(51) Int. Cl.
*B67D 7/06* (2010.01)

(52) U.S. Cl.
USPC ..... 222/144.5; 222/145.1; 222/542; 251/337

(58) Field of Classification Search
USPC ..... 222/144.5, 145.1, 526, 527, 529, 222/542; 251/337; 411/369, 370, 542, 552; 277/628, 637, 910
See application file for complete search history.

(56) References Cited

U.S. PATENT DOCUMENTS

| | | | | | |
|---|---|---|---|---|---|
| 1,291,916 | A | * | 1/1919 | Kendall | 222/542 |
| 2,239,125 | A | * | 4/1941 | Mills | 411/552 |
| 2,260,048 | A | * | 10/1941 | Newell | 411/552 |
| 2,688,289 | A | | 9/1954 | Sterling | |
| 3,123,389 | A | * | 3/1964 | Biesecker | 292/218 |
| 3,136,017 | A | * | 6/1964 | Preziosi | 411/552 |
| 3,503,418 | A | * | 3/1970 | Petrucci et al. | 137/515 |
| 4,448,476 | A | | 5/1984 | Perlman et al. | |
| 4,657,462 | A | * | 4/1987 | Hoen | 411/552 |
| 4,770,586 | A | | 9/1988 | Osterland | |
| 4,921,140 | A | * | 5/1990 | Belcham | 222/144.5 |
| 4,986,449 | A | | 1/1991 | Valiyee | |
| 5,042,692 | A | * | 8/1991 | Valiyee et al. | 222/144.5 |
| 5,251,655 | A | | 10/1993 | Low | |
| 6,322,051 | B1 | | 11/2001 | Salmela | |
| 6,540,463 | B2 | * | 4/2003 | Ward | 411/173 |
| 8,109,413 | B2 | * | 2/2012 | Schroeder et al. | 222/145.5 |
| 2009/0084817 | A1 | * | 4/2009 | Schroeder et al. | 222/144.5 |

* cited by examiner

*Primary Examiner* — Kevin P Shaver
*Assistant Examiner* — Leslie Tanner
(74) *Attorney, Agent, or Firm* — Kilpatrick Townsend & Stockton LLP

(57) ABSTRACT

A locking access plug for a valve return spring for a beverage dispensing gun handle is disclosed. The locking access plug enables the compression and retention of the valve return spring and enables the retention of the locking access plug in the body of the handle until it is acted upon for the purpose of its removal; for example, for the servicing of the handle. A beverage dispensing gun having such a locking access plug can both keep a valve return spring in compression as well as interface with a sealing o-ring that seals between the locking access plug and the beverage dispensing gun handle.

19 Claims, 9 Drawing Sheets

Prior Art

Prior Art

Prior Art

LOCKING ACCESS PLUG FOR A BAR GUN

CROSS-REFERENCES TO RELATED APPLICATIONS

This application claims the benefit of U.S. Provisional Application No. 61/238,047, entitled "Locking Access Plug for a Bar Gun," filed Aug. 28, 2009, the entire disclosure of which is hereby incorporated herein by reference.

BACKGROUND

The present invention relates generally to fluid dispensing devices having an internal valve return spring, and more specifically to a beverage dispensing apparatus of the type in which several different beverages are dispensed from a single beverage dispensing head by pressing an appropriate button. In particular, the present invention is related to improvements in the manner of retention of the valve return springs in such a beverage dispensing apparatus.

Hand-held beverage dispensers that provide an operator with the ability to dispense any of a number of different beverages by merely pressing an appropriate button are known. Such hand-held dispensers are sometimes referred to as bar guns. One such bar gun system is described in the assignee's issued U.S. Pat. No. 4,986,449, entitled: "Beverage Dispensing Apparatus," the entire disclosure of which is hereby incorporated herein by reference.

Known beverage-dispensing devices 12, 14 available from the assignee of the present invention are shown in FIG. 1 and FIG. 2. As shown in these figures, the current state of the art utilizes a disc-shaped part (PH10-25 spring hat) to place a valve return spring (PH10-24) under compression so that the valve return spring acts to maintain a dispensing valve in the "closed" position until otherwise acted upon. FIG. 3 shows a simplified version of the beverage-dispensing devices of FIG. 1 and FIG. 2, and further illustrates how the spring hat (PH10-25) is used to place the valve return spring (PH10-24) under compression. A plurality of these spring hats (PH10-25) are used in a typical assembly and held in position by a covering plate (PH12-27; PH14-27) that is secured by one or more screws (PH10-7). During servicing, the covering plate is removed. Because the valve return springs have significant compressive force, the spring hats (PH10-25) can become dislodged from their positions and be ejected from the immediate assembly for some distance.

The known arrangement, described above, relies solely on the resistance provided by a sealing o-ring (PH10-26) to act against the force of the compressed spring. As one can imagine, when the covering plate (PH12-27, PH14-27) is removed, the compressive force in the valve return spring often causes the corresponding retained parts to be ejected from the handle assembly in an uncontrolled fashion.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The embodiments of the present invention enhance a beverage-dispensing gun handle with locking access plugs to enable the compression and retention of valve return springs and to retain the locking access plugs in the body of the handle until acted upon for removal; for example, for the servicing of the handle. The use of such locking access plugs serves to prevent inadvertent scattering and/or loss of valve return springs and/or related components by allowing selective access and removal of a single valve return spring at a time.

Thus, in one aspect, a fluid dispensing device having an internal valve spring is provided. The fluid dispensing device includes a housing member and a valve assembly. The valve assembly includes a valve spring and a valve spring retainer. The valve spring is disposed within a receptacle of the housing member and biases the valve assembly closed. The valve spring retainer includes a first portion and a second portion attached to the first portion. The first portion is shaped to be received in a receptacle of the housing member and includes a spring receptacle shaped to receive and support an end of the valve spring. For example, each of the first portion of the valve spring retainer and the receptacle of the housing member can have a substantially axially-symmetric shape. The second portion is shaped to engage a complementary-shaped portion of the housing member to retain the first portion within the receptacle of the housing member.

The valve spring can be a helical compression spring. The spring receptacle can be cylindrically shaped, for example, to receive and support an end of such a helical compression spring.

The first portion can be shaped to interface with a sealing o-ring that interfaces with the receptacle of the housing member when the first portion is received within the receptacle of the housing member. For example, the first portion can be shaped to contact the sealing o-ring at least at two points disposed approximately 90 degrees apart relative to a circular cross-section of the sealing o-ring.

The first portion can be shaped to retain the sealing o-ring when the first portion is removed from the receptacle of the housing member. For example, the first portion can be shaped to contact the sealing o-ring at a plurality of points spanning a cross-sectional sector of the sealing o-ring to retain the sealing o-ring.

The valve spring retainer can be rotatable while the first portion is received within the receptacle of the housing member between a non-engaged orientation where the second portion does not engage the complementary-shaped portion of the housing member and an engaged orientation where the second portion does engage the complementary-shaped portion of the housing member. For example, the second portion can include a cantilevered feature and the complementary-shaped portion of the housing member can include a slot that receives the cantilevered feature when the valve spring retainer is in the engaged orientation. The second portion can include a plurality of cantilevered features and the complementary-shaped portion of the housing member can include a plurality of corresponding slots each of which receive one of the cantilevered features when the valve spring retainer is in the engaged orientation. The plurality of cantilevered features can be uniformly distributed around an axis of rotation of the valve spring retainer. And the second portion can be centered relative to the first portion. A majority of the second portion can have a thickness in the direction of an axis of rotation of the valve spring retainer and the cantilevered feature can have a thickness in the direction of the axis of rotation that is less than the second portion majority thickness (e.g., half the second portion majority thickness).

The second portion of the valve spring retainer can include a recessed drive feature shaped to receive the distal end of a tool so that the valve spring retainer can be rotated between the engaged and non-engaged orientations via the tool. For example, the recessed drive feature can include an elongated slot shaped to interface with a flat-bladed screwdriver. In general, the recessed drive feature can be any suitable drive feature (e.g., square drive, cross-recessed, star drive, torx, etc.).

In many embodiments, the second portion is shaped to constrain the position of the first portion of the valve spring retainer in the receptacle of the housing member. For example, the second portion can include a planar surface that interfaces with a planar surface of the housing member to constrain the position of the first portion of the valve spring retainer in the receptacle of the housing member.

In another aspect, a beverage dispensing gun is provided. The beverage dispensing gun includes a handle member and a plurality of valve assemblies. Each of the valve assemblies includes a helical compression spring and a valve spring retainer. Each of the helical compression springs is disposed within a corresponding receptacle of the handle member and biases the corresponding valve assembly closed. At least one of the valve spring retainers includes a first portion and a second portion attached to the first portion. The first portion is shaped to be received in the corresponding receptacle of the handle member. And the first portion includes a spring receptacle shaped to receive and support an end of the corresponding helical compression spring. The second portion is shaped to engage a complementary-shaped portion of the handle member to retain the first portion within the corresponding receptacle of the handle member.

The first portion can be shaped to interface with a sealing o-ring. The sealing o-ring interfaces with the corresponding receptacle of the handle member when the first portion is received within the corresponding receptacle of the handle member.

The valve spring retainer can be rotatable when the first portion is received within the corresponding receptacle of the handle member between a non-engaged orientation and an engaged orientation. In the non-engaged orientation, the second portion does not engage the complementary-shaped portion of the handle member. In the engaged orientation, the second portion does engage the complementary-shaped portion of the handle member.

The second portion can include a recessed drive feature shaped to receive the distal end of a tool. With such a recessed drive feature, the valve spring retainer can be rotated between the engaged and non-engaged orientations via the tool.

For a further understanding of the nature and advantages of the invention, reference should be made to the following description taken in conjunction with the accompanying figures. It is to be expressly understood, however, that each of the figures is provided for the purpose of illustration and description only and is not intended as a definition of the limits of the embodiments of the present invention.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention can be practiced without the specific details. Furthermore, well-known features may be omitted or simplified in order not to obscure the embodiment being described.

The described embodiments of the present invention enhance a beverage-dispensing gun with locking access plugs to enable the compression and retention of the valve return springs and to retain the locking access plugs until acted upon for removal; for example, to service the beverage-dispensing gun. A beverage dispensing gun having such a locking access plug can both retain the valve return spring in compression as well as accept an o-ring for the purpose of sealing the related opening.

Figure 1:
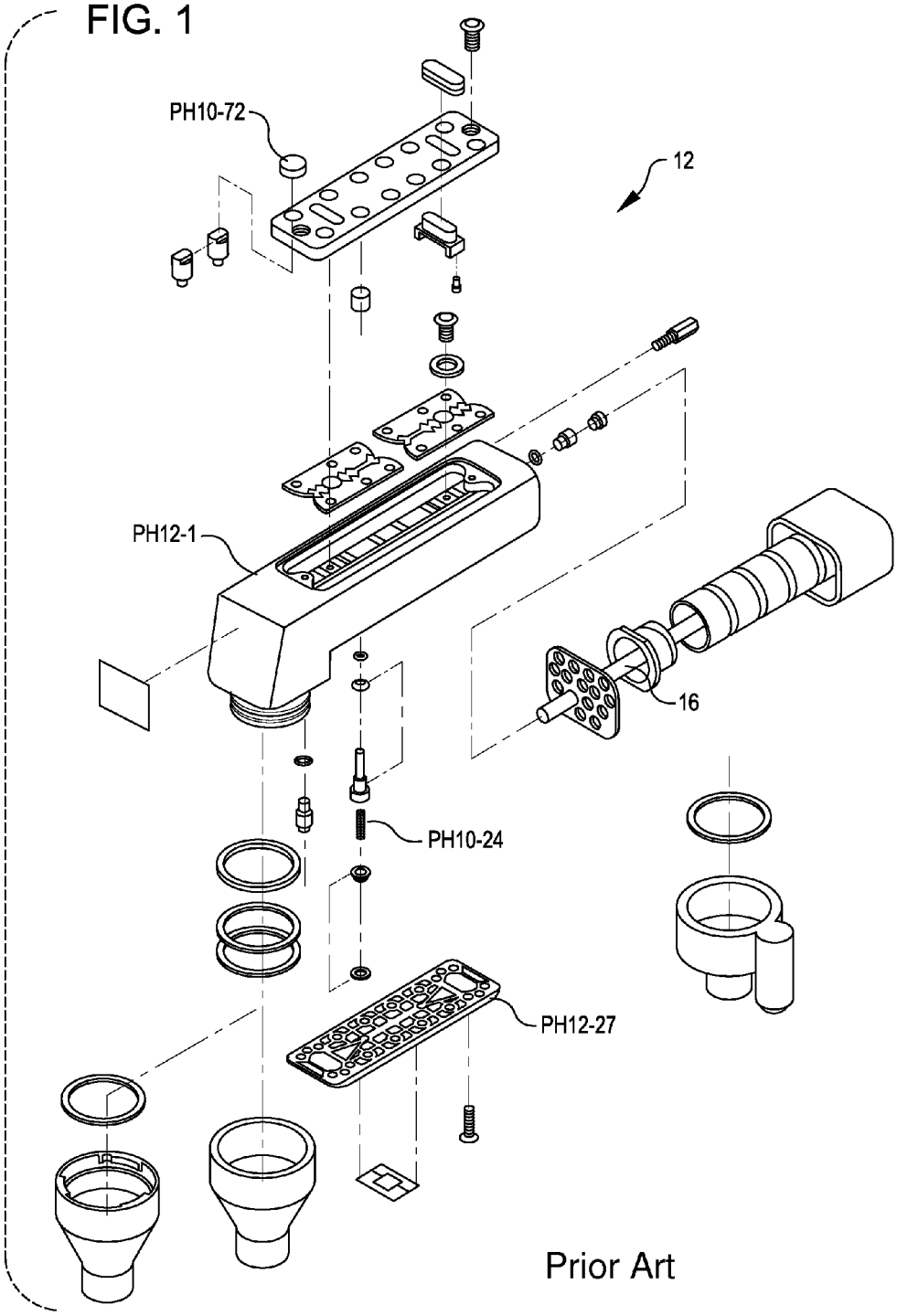
FIG. 1 is an exploded parts view drawing of a 12 button post-mix beverage-dispensing gun.
Figure 2:
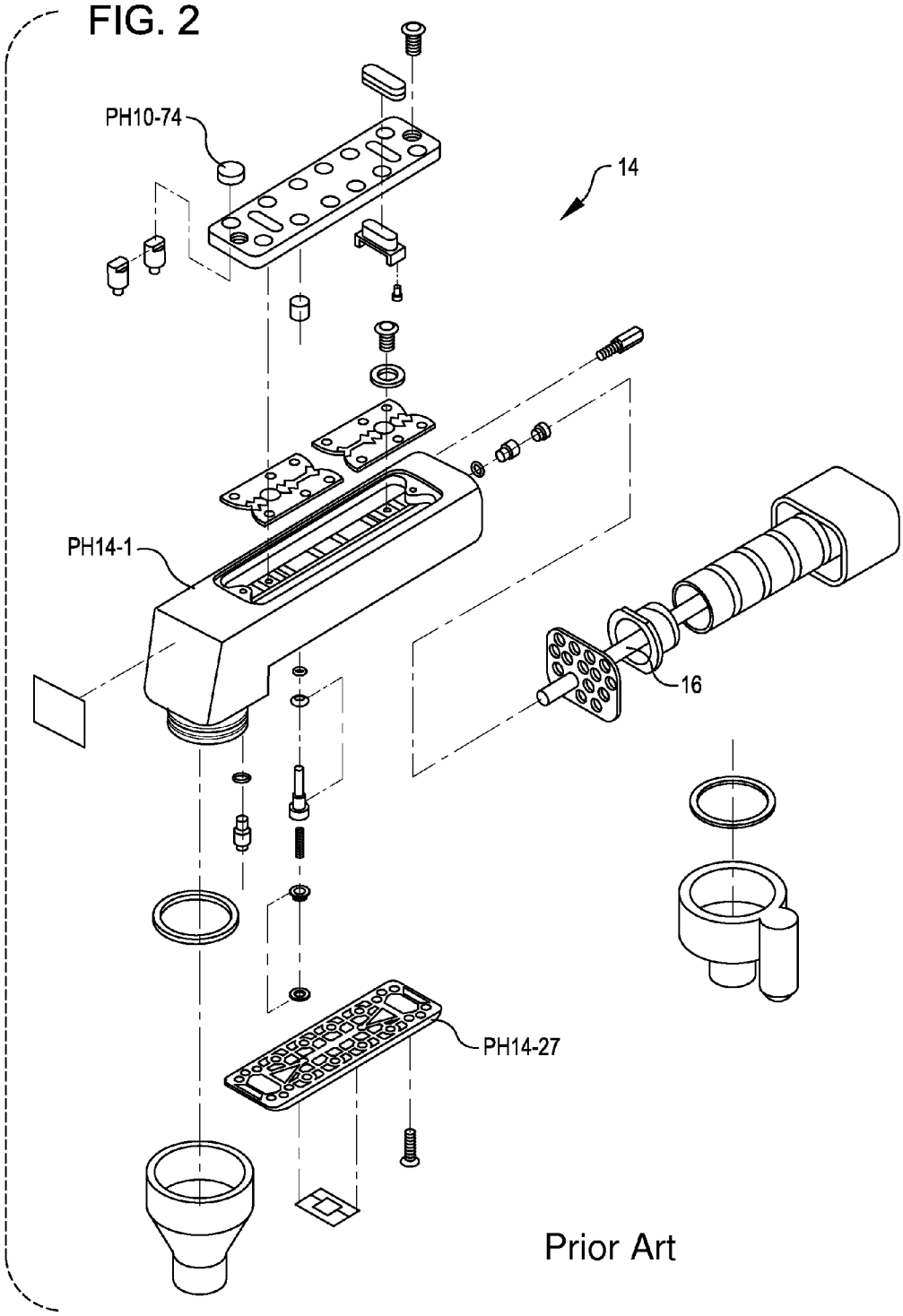
FIG. 2 is an exploded parts view drawing of a 14 button post-mix beverage-dispensing gun.

Referring now to the drawings, in which like reference numerals represent like parts throughout the several views, FIG. 1 shows an exploded parts view drawing of a twelve-button post-mix beverage-dispensing gun 12. And FIG. 2 shows an exploded parts view drawing of a fourteen-button post-mix beverage-dispensing gun 14. The beverage dispensing guns 12, 14 include a handle member (PH12-1, PH14-1) that accommodates a mixing assembly that includes a plurality of valve assemblies. A plurality of beverage fluids are delivered to the mixing assembly via individual fluid lines (e.g., fluid line 16), where the beverage fluids are selectively dispensed from the beverage-dispensing guns 12, 14 by selective activation of the valve assemblies via depressing associated selection buttons (PH10-74).

Each of the valve assemblies includes a valve return spring (PH10-24) (e.g., a helical compression spring). A cover plate (PH12-27, PH14-27) is used to retain the valve spring assemblies within corresponding apertures of the handle member (PH12-1, PH14-1).

Figure 3:
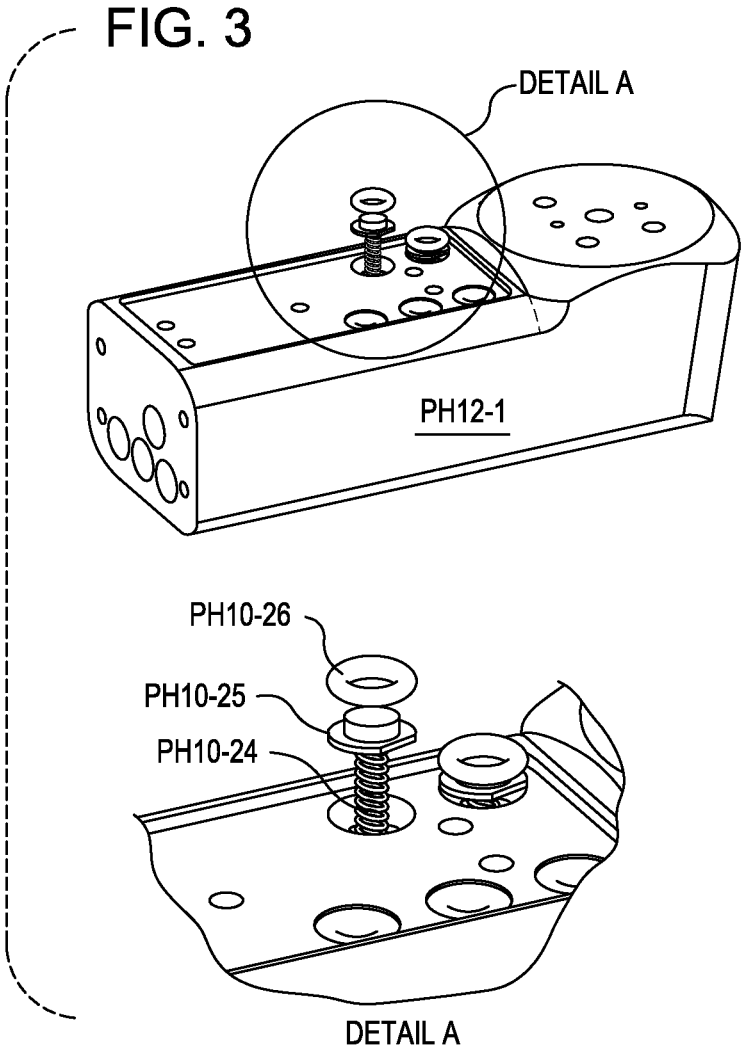
FIG. 3 is simplified exploded parts view drawing of a beverage dispensing gun handle showing a valve return spring setup.

FIG. 3 is a simplified drawing of the handle member (PH12-1) with the cover plate (PH12-27) removed (not shown) and illustrates details of a spring hat (PH10-25) and a sealing o-ring (PH10-26). As can be seen from FIGS. 1 through 3, with the cover plate (PH12-27) removed, other than friction between the sealing o-ring (PH10-26) and the handle member (PH12-1), there is nothing to prevent the valve return spring (PH10-24) from being ejected from the handle member (PH12-1) thereby scattering related components (e.g., the sealing o-ring (PH10-26), the spring hat (PH10-25), the valve return spring (PH10-24)). Thus, when the beverage dispensing guns 12, 14 are disassembled, the parts of the valve assemblies do not always stay in place and tend to be scattered due to the energy of the compressed valve return springs (PH10-24).

Figure 4A:
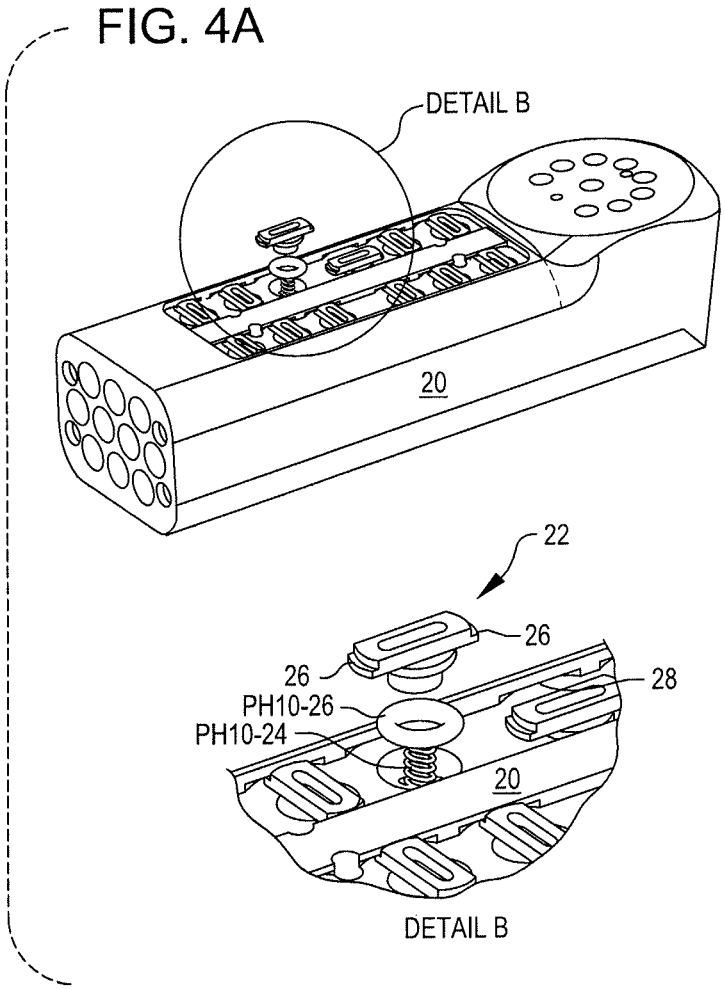
FIG. 4A and FIG. 4B illustrate a beverage dispensing gun handle with locking access plugs in accordance with many embodiments.
Figure 4B:
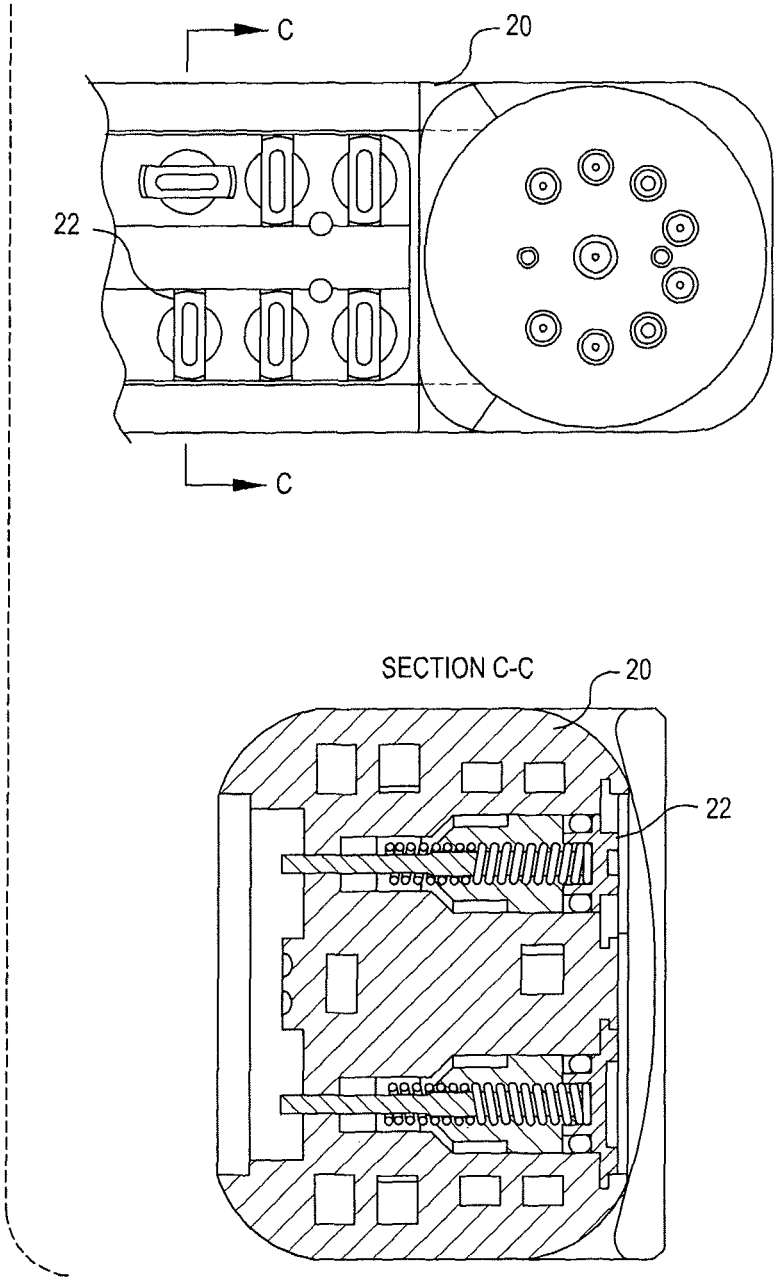

FIG. 4A and FIG. 4B illustrate a beverage-dispensing gun handle 20 with a plurality of locking access plugs 22 in accordance with many embodiments. As can be seen in FIG. 4A and FIG. 4B, the locking access plug 22 is shaped to engage a complementary-shaped portion of the beverage-dispensing gun handle 20 to retain a compressed valve return spring (PH10-24). Each of the locking access plugs 22 can be individually removed to provide for the selective removal of the corresponding valve assemblies. The locking access plug 22 are also shaped and dimensioned to engage complementarily-shaped structures of the sealing o-ring (PH10-26) and the beverage-dispensing gun handle 20 so that the locking access plug 22 can stay in place when the beverage-dispensing gun handle 20 is partially disassembled. The locking access plug 22 includes two opposed cantilevered features 26 that are shaped to be received within complementary-shaped slots 28 of the beverage-dispensing gun handle 20 when the locking access plug 22 is in an engaged orientation relative to the beverage-dispensing gun handle 20.

Figure 5A:
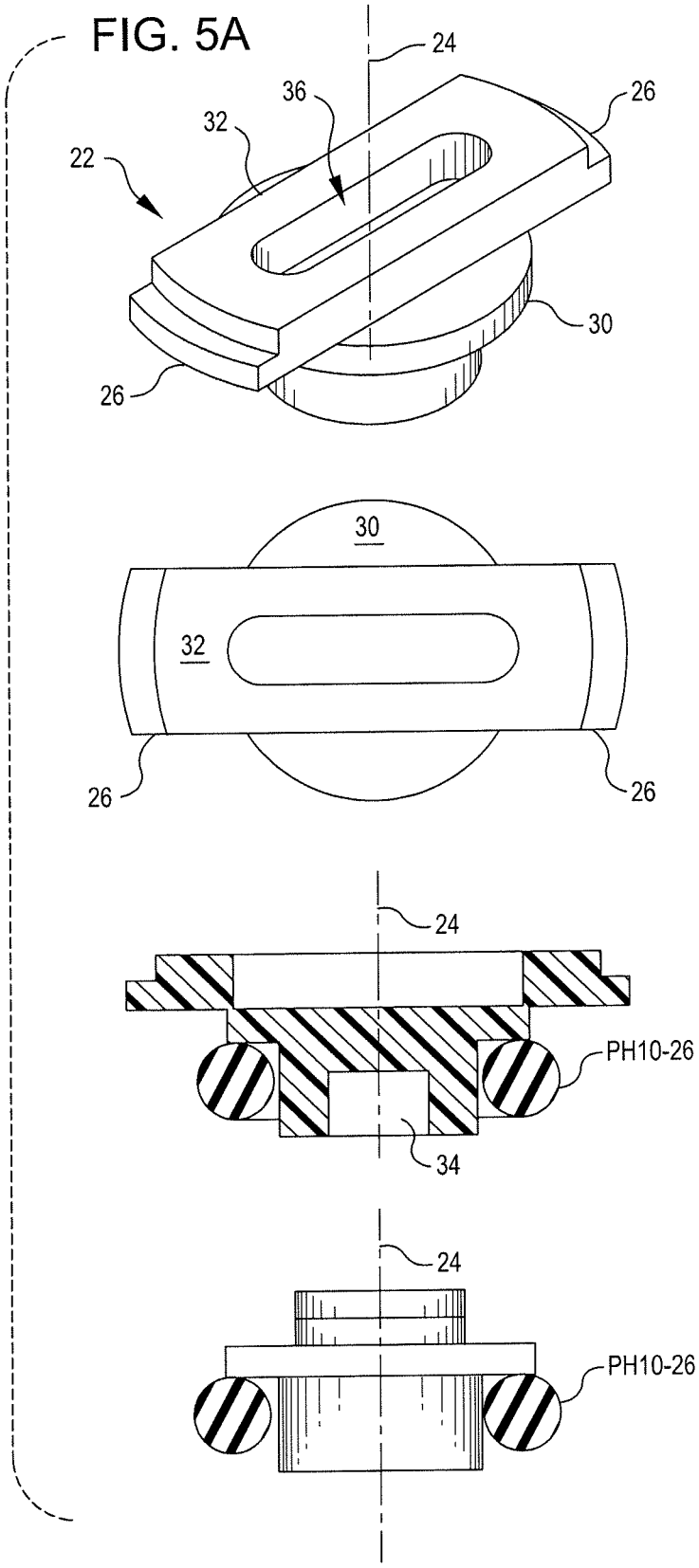
FIG. 5A illustrates various details of the locking access plugs of FIG. 4A and FIG. 4B.

FIG. 5A illustrates various details of the locking access plug 22 of FIG. 4A and FIG. 4B. The locking access plug 22 includes a first portion 30 that is shaped and sized to be received in a corresponding receptacle of the beverage-dispensing gun handle 20 and a second portion 32 attached to the first portion. The first portion 30 includes a spring receptacle 34 shaped to receive and support an end of the valve return spring (PH10-24). The spring receptacle 34 is cylindrically shaped and sized to accommodate an end of the valve return spring (PH10-24).

The first portion 30 is also shaped to interface with the sealing o-ring (PH10-26). As illustrated in FIG. 5A, the sealing o-ring (PH10-26) interfaces with the first portion 30 and protrudes by a suitable amount beyond the radial limits of the first portion 30 to suitably interface with the receptacle of the beverage-dispensing gun handle 20 to seal between the locking access plug 22 and the beverage-dispensing gun handle 20.

The second portion 32 is shaped to engage the complementary-shaped slots 28 in the beverage-dispensing gun handle 20. The second portion 32 includes the cantilevered features 26, which are received within the complementary-shaped slots 28 when the locking access plug 22 is in the engaged orientation. To install the locking access plug 22, the locking access plug is oriented so that the cantilevered features 26 are oriented away from the complementary-shaped slots 28 (e.g., horizontally oriented as shown for the upper left locking access plug as shown in FIG. 4B); the first portion 30 is then inserted into the receptacle of the beverage-dispensing gun handle 20; and then the locking access plug 22 is rotated about an axis of rotation 24 so that the cantilevered features 26 are received within the slots 28 (e.g., vertically oriented as shown for five of the six locking access plugs shown in FIG. 4B).

The locking access plug 22 includes a recessed drive feature 36. While the recessed drive feature shown is an elongated slot shaped to interface with a flat-bladed screwdriver, any suitable recessed drive feature can be used (e.g., square drive, cross-recessed, torx, etc.).

The locking access plug 22 can be a monolithic part. The locking access plug 22 can be made from any suitable material, for example, an appropriate plastic material by a casting, injection molding or other suitable manufacturing processes.

Figure 5B:
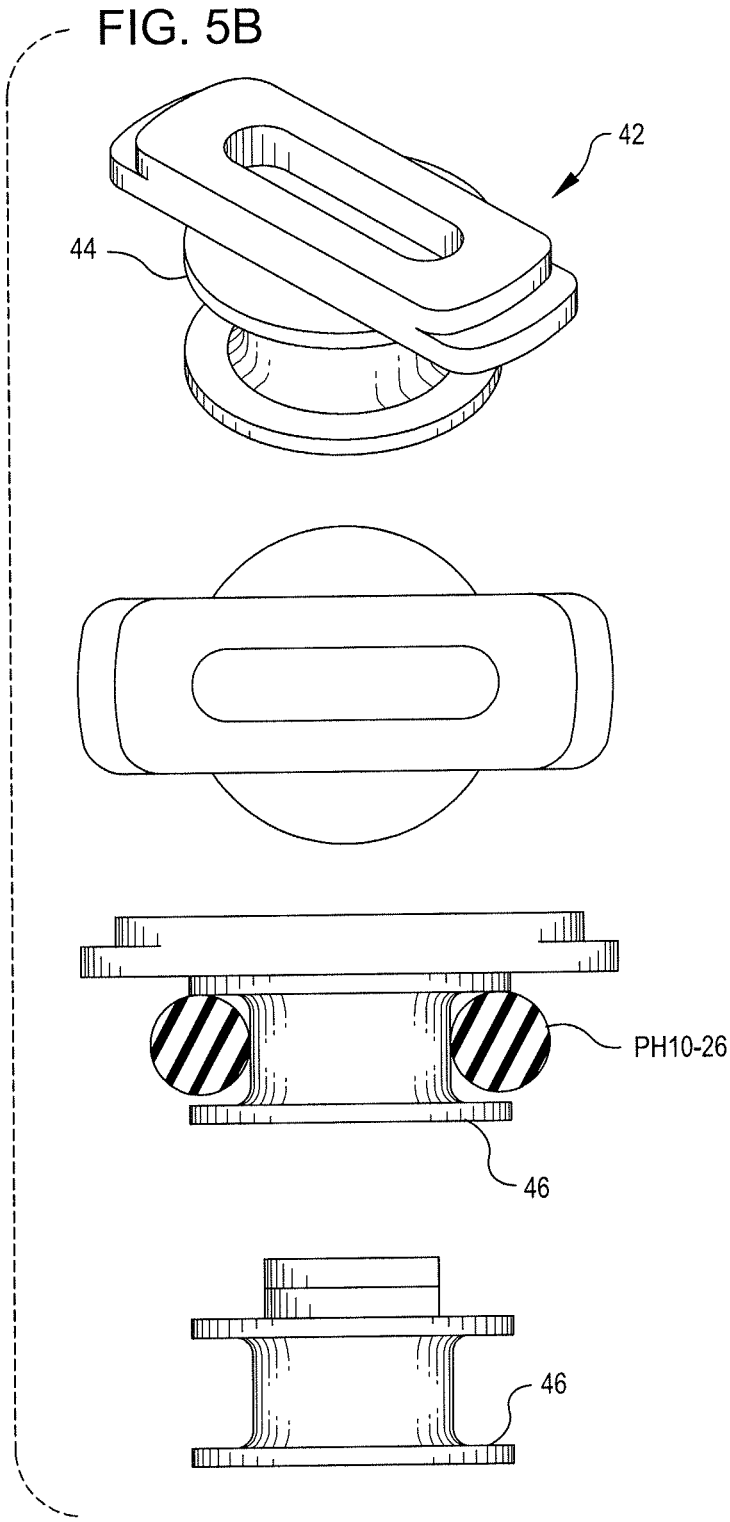
FIG. 5B illustrates various details of a locking access plug shaped to retain a sealing o-ring, in accordance with many embodiments.

FIG. 5B illustrates a locking access plug 42 that includes a first portion 44 shaped to retain the sealing o-ring (PH10-26). The locking access plug 42 is similar to the locking access plug 22, but further includes a retention flange 46 that prevents inadvertent separation of the sealing o-ring (PH10-26) from the first portion 44. For example, when the locking access plug 42 is removed from the receptacle of the beverage dispensing gun handle 20, the retention flange 46 ensures that the sealing o-ring does not slip off the locking access plug 42 and remain in the receptacle.

Figure 6:
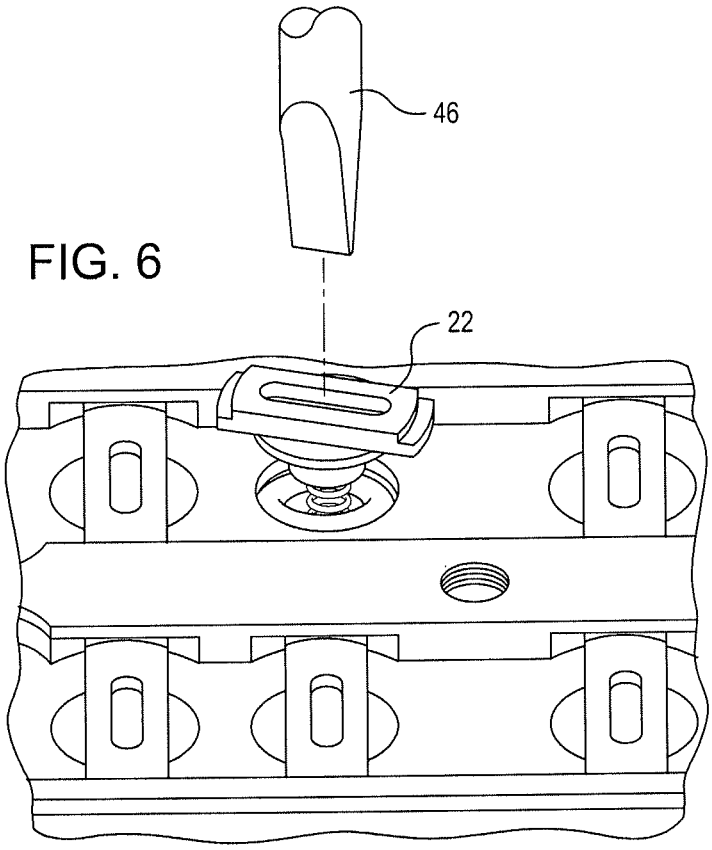
FIG. 6 shows the locking access plug of FIG. 4A and FIG. 4B and a driver used to engage the locking access plug.

FIG. 6 shows the locking access plug 22 and a flat-bladed screw driver 46 used to engage the locking access plug 22. The locking access plug 22 is shown positioned so that the protruding end of an uncompressed valve return spring (PH10-24) is received within the spring receptacle 34. The flat-bladed screw driver 46 is inserted into the recessed drive feature 36 and used to push the first portion 30 into the receptacle of the beverage-dispensing gun handle 20, thereby compressing the valve return spring (PH10-24).

Figure 7:
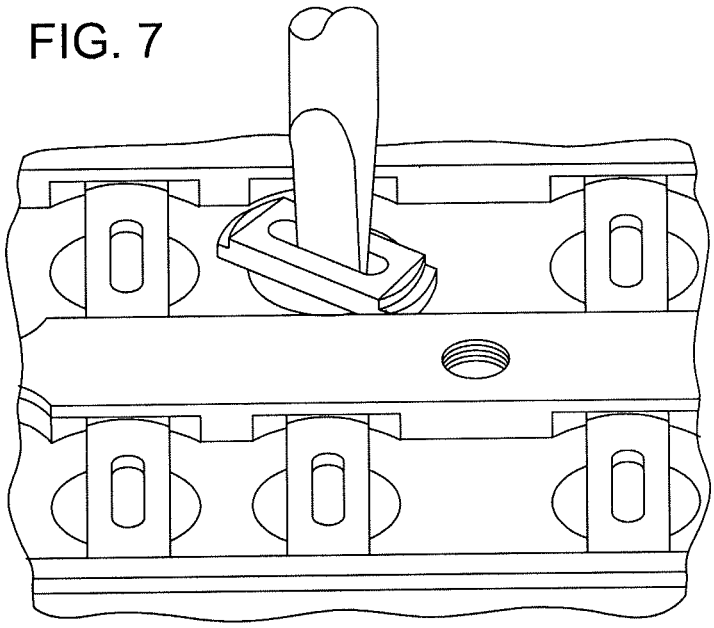
FIG. 7 shows the locking access plug of FIG. 4A and FIG. 4B being rotated between a non-engaged orientation and an engaged orientation via a driver.

The locking access plug 22 can then be rotated about the axis of rotation 24 so that the cantilevered features 26 are received within the complementary-shaped slots 28 of the beverage-dispensing gun handle 20. FIG. 7 shows the locking access plug 22 being turned with the flat-bladed screw driver 46 to lock or unlock the locking access plug 22 with respect to the beverage-dispensing gun handle 20.

Figure 8:
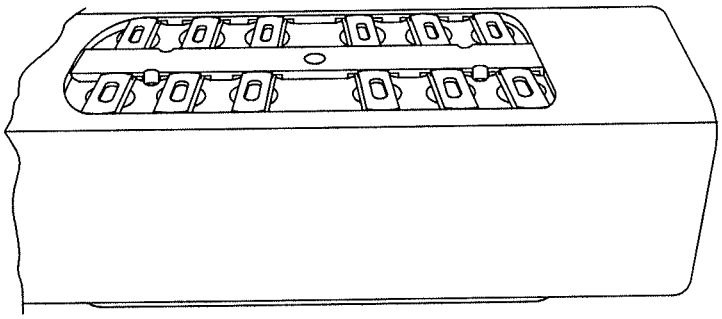
FIG. 8 shows a beverage dispensing handle with a plurality of locking access plugs in accordance with many embodiments.

As shown in FIG. 8, a plurality of locking access plugs can be used to retain a corresponding plurality of valve assemblies within a handle of a beverage-dispensing gun via complementarily-shaped mating features that engage one-another. Advantageously, each of the locking access plugs can be selectively installed/un-installed in any desired order. Accordingly, scattering and/or loss of components of the valve assemblies can be minimized and/or eliminated.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A fluid dispensing device having an internal valve spring, the fluid dispensing device comprising:

a housing member;

a valve assembly comprising a valve spring and a valve spring retainer, the valve spring disposed within a receptacle of the housing member and biasing the valve assembly closed, the valve spring retainer comprising a first portion shaped to be received in a receptacle of the housing member, the first portion comprising a spring receptacle shaped to receive and support an end of the valve spring, and a second portion attached to the first portion, the second portion shaped to engage a complementary-shaped portion of the housing member to retain the first portion within the receptacle of the housing member wherein the valve spring retainer is moveable between a non-engaged orientation where the second portion does not engage the complementary-shaped portion of the housing member and an engaged orientation where the second portion does engage the complementary-shaped portion of the housing member by rotation of the valve spring retainer in both a clockwise and counter-clockwise direction and wherein the second part of each valve spring member is externally accessible when engaged within the receptacle of the housing member such that the valve assembly is directly removable from the housing member.

2. The fluid dispensing device of claim 1, wherein the valve spring is a helical compression spring.

3. The fluid dispensing device of claim 2, wherein the spring receptacle has a cylindrical shape.

4. The fluid dispensing device of claim 1, wherein the first portion is shaped to interface with a sealing o-ring that interfaces with the receptacle of the housing member when the first portion is received within the receptacle of the housing member.

5. The fluid dispensing device of claim 4, wherein the first portion is shaped to contact the sealing o-ring at least at two points disposed approximately 90 degrees apart relative to a circular cross-section of the sealing o-ring.

6. The fluid dispensing device of claim 4, wherein the first portion is shaped to retain the sealing o-ring when the first portion is removed from the receptacle of the housing member.

7. The fluid dispensing device of claim 6, wherein the first portion is shaped to contact the sealing o-ring at a plurality of points spanning a cross-sectional sector of the sealing o-ring to retain the sealing o-ring.

8. The fluid dispensing device of claim 1, wherein each of the first portion of the valve spring retainer and the receptacle of the housing member has a axially-symmetric shape.

9. The fluid dispensing device of claim 1, wherein the second portion comprises a cantilevered feature and the complementary-shaped portion of the housing member comprises a slot that receives the cantilevered feature when the valve spring retainer is in the engaged orientation.

10. The fluid dispensing device of claim 9, wherein the second portion comprises a plurality of cantilevered features and the complementary-shaped portion of the housing member comprises a plurality of corresponding slots each of which receive one of the cantilevered features when the valve spring retainer is in the engaged orientation.

11. The fluid dispensing device of claim 10, wherein the plurality of cantilevered features are uniformly distributed around an axis of rotation of the valve spring retainer and the second portion is centered relative to the first portion.

12. The fluid dispensing device of claim 9, wherein a majority of the second portion has a thickness in the direction of an axis of rotation of the valve spring retainer and the cantilevered feature has a thickness in the direction of the axis of rotation that is less than the second portion majority thickness.

13. The fluid dispensing device of claim 12, wherein the thickness of the cantilever feature is half the second portion majority thickness.

14. The fluid dispensing device of claim 1, wherein the second portion comprises a recessed drive feature shaped to receive a distal end of a tool so that the valve spring retainer can be rotated between the engaged and non-engaged orientations via the tool.

15. The fluid dispensing device of claim 14, wherein the recessed drive feature comprises an elongated slot shaped to interface with a flat-bladed screwdriver.

16. The fluid dispensing device of claim 1, wherein the second portion comprises a planar surface that interfaces with a planar surface of the housing member to constrain the position of the first portion in the receptacle of the housing member.

17. A beverage dispensing gun, comprising:

a handle member; and a plurality of valve assemblies, each of the valve assemblies comprising a helical compression spring and a valve spring retainer, each of the helical compression springs disposed within a corresponding receptacle of the handle member and biasing the corresponding valve assembly closed, at least one of the valve spring retainers comprising a first portion shaped to be received in the corresponding receptacle of the handle member, the first portion comprising a spring receptacle shaped to receive and support an end of the corresponding helical compression spring, and a second portion attached to the first portion, the second portion shaped to engage a complementary-shaped portion of the handle member to retain the first portion within the corresponding receptacle of the handle member wherein each valve spring retainer is moveable between a non-engaged orientation where the second portion does not engage the complementary-shaped portion of the housing member and an engaged orientation where the second portion does engage the complementary-shaped portion of the housing member by rotation of the valve spring retainer in both a clockwise and counter-clockwise direction and wherein the second part of the valve spring member is externally accessible when engaged within the receptacle of the housing member such that the valve assembly is directly removable from the housing member.

18. The beverage dispensing gun of claim 17, wherein:

the first portion is shaped to interface with a sealing o-ring that interfaces with the corresponding receptacle of the handle member when the first portion is received within the corresponding receptacle of the handle member.

19. The beverage dispensing gun of claim 18, wherein the second portion comprises a recessed drive feature shaped to receive a distal end of a tool so that the valve spring retainer can be rotated between the engaged and non-engaged orientations via the tool.

* * * * *